United States Patent [19]

Lancz

[11] 3,965,026

[45]*June 22, 1976

[54] GERMICIDAL ALL-PURPOSE LIQUID CLEANER

[75] Inventor: Albert Jay Lancz, Piscataway, N.J.

[73] Assignee: Colgate-Palmolive Company, New York, N.Y.

[ * ] Notice: The portion of the term of this patent subsequent to May 21, 1991, has been disclaimed.

[22] Filed: Sept. 20, 1974

[21] Appl. No.: 507,840

Related U.S. Application Data

[63] Continuation of Ser. No. 270,186, July 10, 1972, abandoned.

[52] U.S. Cl. ..... 252/106; 252/546; 252/547

[51] Int. Cl.[2] ..... C11D 1/10; C11D 1/62; C11D 3/48

[58] Field of Search ..... 252/106, 107, 527, 528, 252/546, 547; 424/326

[56] References Cited

UNITED STATES PATENTS

| | | | |
|---|---|---|---|
| 3,223,644 | 12/1965 | Law | 252/106 |
| 3,282,775 | 11/1966 | Stonehill | 424/329 |
| 3,553,141 | 1/1971 | Katsumi et al. | 252/106 |
| 3,812,046 | 5/1974 | Lancz | 252/106 |
| 3,836,669 | 9/1974 | Dadekian | 424/329 |

FOREIGN PATENTS OR APPLICATIONS

| | | |
|---|---|---|
| 6,802,352 | 8/1968 | Netherlands |
| 795,814 | 5/1958 | United Kingdom |

OTHER PUBLICATIONS

Ditoro et al., "Quaternary Applications", Detergent and Specialties, Jan. 1969, pp. 56, 84 & 85.

Pollard, "Amino Acid Chelating Agents in Detergent Applications", pp. 58–62, 130–135, Soap & Chemical Specialties, Sept. 1966.

"Sequestrene", Alrose Chem. Co., Prov., R.I., July 1952, pp. 25 & 26.

"Products and Processes", Soap & Chem. Specialties, July 1962, p. 159.

*Primary Examiner*—P.E. Willis, Jr.

*Attorney, Agent, or Firm*—Herbert S. Sylvester; Murray M. Grill; Norman Blumenkopf

[57] ABSTRACT

Germicidal, all-purpose liquid cleaner contains a quaternary ammonium compound germicide and nitrilotriacetic acid or its salts. A nonionic surfactant and sodium bicarbonate stabilizer may be included.

4 Claims, No Drawings

GERMICIDAL ALL-PURPOSE LIQUID CLEANER

This is a continuation, of application Ser. No. 270,186, filed July 10, 1972.

BACKGROUND OF THE INVENTION

The present invention relates to germicidal liquid cleaners and particularly to phosphate-free germicidal cleaners.

Liquid detergent compositions intended to be dissolved in water to form detergent solutions have been used in households and industry for cleaning floors, walls, dishes, food processing equipment, etc. These products have not been particularly effective in destroying infectious bacteria, and a separate sanitizing step in inconvenient. Therefore, the formulation of a product with both good disinfecting and detergent properties is desirable, and such a product is particularly valuable for use in hospitals, institutions and hotels, as well as homes.

One of the most effective commercially available sanitizers is a mixture of alkyl dimethyl benzyl ammonium chlorides. The mixture generally consists of alkyl dimethyl benzyl ammonium chlorides whose alkyl groups can range from $C_8$ to $C_{18}$, although its most effective germicidal components are those whose alkyl groups are $C_{12} - C_{16}$.

SUMMARY OF THE INVENTION

It has now been discovered that the detergent efficiency of quaternary ammonium germicides can be greatly enhanced by the addition of nitrilotriacetic acid alkali salts to solutions of quaternary sanitizers. Nitrilotriacetic acid alkali salts are particularly effective sequestering agents which remove the hardness from water and, additionally, increase rather than diminish the germicidal effects of the quaternary ammonium sanitizers.

The detergent formulations containing a mixture of a quaternary ammonium sanitizing compound and nitrilotriacetic acid alkali salt thereof have been found highly effective against a broad spectrum of microorganisms. Where enhanced cleaning action is desired, a nonionic detergent is incorporated in the composition, with no appreciable loss of germicidal properties.

The products formulated according to the present invention are stable, homogeneous, and clear at temperatures between 30°F. and 120°F. The cleaning performance at several dilutions was found to be efficient.

The quaternary surfactants suitable for use in the germicidal liquid cleaner of the present invention may include alkyl dimethyl benzyl ammonium chlorides in which the alkyl group contains from about 8 to about 18 carbon atoms. It has been found that from about 0.10% to about 15.0% by weight, preferably from about 4.5% to about 10.0% by weight of the quaternary germicide is required.

"Roccal" or "Cyncal", sold by Sterling Drug, have been found to be commercial quaternary germicidal ingredients suitable for use in the novel cleaners of the present invention. In these alkyl dimethyl benzyl ammonium chlorides the alkyl chain contains 8–18 carbon atoms. Other compatible typical quaternary ammonium compounds may be used, such as ethyl dimethyl stearyl ammonium chloride, benzyl dimethyl stearyl ammonium chloride, trimethyl stearyl ammonium chloride, trimethyl cetyl ammonium chloride, dimethyl ethyl lauryl ammonium chloride, dimethyl propyl myristyl ammonium chloride, and the corresponding bromides and acetates.

Nitrilotriacetic acid tri-sodium salt is the preferred builder, although other mono-, di- or trialkali salts of nitrilotriacetic acid can also be used. The builder is present in amounts ranging from about 1.0% to about 25.0% by weight, preferably from about 2.5% to about 12.5% by weight. One important advantage of the nitrilotriacetic acid trisodium salt builder is that homogeneous solutions, even on dilution are obtained where it is used. This is important in view of the fact that certain phosphate builders are incompatible with the quaternary germicides under usual storage conditions. In addition, nitrilotriacetic acid and its salts do not contribute to undesirable algae growth in waterways as do the phosphate builders. Where extra cleaning power is desired, a nonionic surfactant may be included in the compositions of the present invention. The nonionic surfactant used may be, for example, a polyethoxylate of a fatty alcohol containing from about 10 to about 16 carbon atoms and having an MR (mole ratio of combined ethylene oxide to hydrophobe) of at least 5. It has been found that the germicidal cleaners of the present invention may contain from 0% to about 10.0% by weight, and preferably from about 0.1% to 5.0% by weight, of these polyethoxylates in combination with the other ingredients as set forth.

A stabilizer, such as sodium bicarbonate, in amounts ranging from about 0% to about 2.0% by weight, preferably from about 0.2% to about 1.0% by weight, may be added to the novel cleaners of the present invention.

These liquid cleaners, when used as directed, are capable of destroying various Gram-positive and Gram-negative bacteria.

DESCRIPTION OF THE PREFERRED EMBODIMENTS

The following compositions are set forth by way of example of my novel germicidal liquid cleaners.

EXAMPLE I

| | Percent by Weight |
|---|---|
| Alkyl* dimethyl benzyl ammonium chloride | 5.0 |
| Nitrilotriacetic acid trisodium salt | 9.6 |
| Fatty alcohol ($C_{10} - C_{12}$) polyethoxylate (MR-5) | 3.2 |
| $NaHCO_3$ | 0.8 |
| Balance water, dye, perfume | |
| | 100.00 |

*Average MW-197: $C_{12}$, 40%: $C_{14}$, 20%: balance $C_8$, $C_{16}$, and $C_{18}$.

The cleaning and germicidal properties of this product have been established even when it is diluted to 64 times its own volume with water.

EXAMPLE II

| | Percent by Weight |
|---|---|
| Alkyl* dimethyl benzyl ammonium chloride | 3.5 |
| Nitrilotriacetic acid trisodium salt | 9.6 |
| $NaHCO_3$ | 0.8 |
| Balance Water | |
| | 100.00 |

*Average MW-197: $C_{12}$, 40%: $C_{14}$, 20%: balance $C_8$, $C_{10}$, $C_{16}$, and $C_{18}$.

EXAMPLE III

| | Percent by Weight |
|---|---|
| Alkyl* dimethyl benzyl ammonium chloride | 3.2 |
| Nitrilotriacetic acid trisodium salt | 4.8 |
| Polyoxyethylene cocoamine | 0.2 |
| $NaHCO_3$ | 0.5 |
| Balance Water | |
| | 100.00 |

*50% $C_{14}$; 40% $C_{12}$; 10% $C_{16}$

The effectiveness of the composition of Example I against standard test micro-organisms can be demonstrated in the AOAC Phenol Coefficient test (8th. Edition (1955), p. 87). The diluted concentration sufficient to kill bacteria in broth culture during a ten minute exposure period is compared with the concentration of phenol required for a kill under identical conditions. The phenol coefficient of the composition of EXAMPLE I against *Salmonella typhosa* (Hopkins strain 26) at 20°C. in Letheen broth was 12.5.

The composition of Example I was then listed by the AOAC Use-dilution confirmation test (10th. Edition, 1965). Bacteria are dried on a metal loop which is then exposed to the germicidal solution to be tested for ten minutes at 20°C. to a subculture tube and incubation for 48 hours at 37°C. No growth should be evident in any of the subculture tubes if the diluted composition is effective. Further, as a check against "stasis" because of carry-over of dried germicidal solution on the metal loop, the metal loops are generally re-subcultured and incubated for another 48 hour period at 37°C. to demonstrate that a true kill is obtained as opposed to stasis, or inhibition of growth. The results of the use-dilution confirmation method are as follows for 1.56% concentration of the composition of Example I:

1. Against *Staphylococcus aureus* — no growth in any of the 30 subculture and 30 resubculture tubes tested.
2. Against *Salmonella choleraesius* — no growth in the 30 subculture or the 30 resubculture tubes.
3. Against *Pseudomonas aeruginosa* — no growth in the 30 subculture or the 30 resubculture tubes.

4. Against both *Salmonella choleraesius* and *Proteus vulgaris* — no growth in the 30 subculture or the 30 resubculture tubes.

The foregoing tests are particularly significant, indicating that the germicidal activity is outstanding.

It is understood that changes and variations may be made in the present invention by one skilled in the art without departing from the spirit and scope thereof as defined in the appended claims.

What is claimed is:

1. An aqueous germicidal liquid cleaner which is stable, homogeneous and clear at temperatures between 30°F. and 120°F. consisting essentially of 1. from about 0.10% to about 15.0% by weight of a quaternary ammonium compound selected from the group consisting of trimethyl stearyl ammonium chloride, trimethyl cetyl ammonium chloride, dimethyl ethyl lauryl ammonium chloride and dimethyl propyl myristyl ammonium chloride,
2. from about 1.0% to about 25.0% by weight of nitrilotriacetic acid trisodium salt,
3. from about 0% to about 10.0% by weight of a polyethoxylate of a $C_{10}$–$C_{16}$ fatty alcohol having a mole ratio of combined ethylene oxide to said fatty alcohol of at least 5, and
4. the balance water.

2. A germicidal liquid cleaner according to claim 1 in which the ingredients (1), (2), and (3) are in a quantity, respectively:

1. from about 4.5% to about 10.0% by weight of germicidal quaternary ammonium compound,
2. from about 2.5% to about 12.5% by weight of nitrilotriacetic acid trisodium salt,
3. from about 1.0% to about 5.0% by weight of fatty alcohol polyethoxylate.

3. A germicidal liquid cleaner according to claim 1 containing up to about 0.8% by weight of sodium bicarbonate.

4. A germicidal liquid cleaner according to claim 2 containing about 0.8% by weight of sodium bicarbonate.

* * * * *